US008760839B1

(12) United States Patent
Mathis

(10) Patent No.: US 8,760,839 B1
(45) Date of Patent: Jun. 24, 2014

(54) ANTI-INTRUSION MAT AND ASSOCIATED USE THEREOF

(71) Applicant: Harold Mathis, Bayville, NJ (US)

(72) Inventor: Harold Mathis, Bayville, NJ (US)

( * ) Notice: Subject to any disclaimer, the term of this patent is extended or adjusted under 35 U.S.C. 154(b) by 0 days.

(21) Appl. No.: 13/679,000

(22) Filed: Nov. 16, 2012

(51) Int. Cl.
*F41B 15/00* (2006.01)

(52) U.S. Cl.
USPC ..... 361/232

(58) Field of Classification Search
USPC ..... 361/232
See application file for complete search history.

(56) References Cited

U.S. PATENT DOCUMENTS 1,165,485 A * 12/1915 Adams ..... 43/59
2,579,214 A * 12/1951 Taylor ..... 109/10
4,274,123 A * 6/1981 Rogers, Jr. ..... 361/232
5,654,867 A 8/1997 Murray
6,369,459 B1 4/2002 Stevens
6,581,712 B1 6/2003 Nathans
7,249,436 B2 * 7/2007 Ravenelle et al. ..... 43/98
8,085,161 B2 * 12/2011 Garcia ..... 340/686.1
8,354,938 B2 * 1/2013 Garcia ..... 340/686.1
2006/0232370 A1 * 10/2006 Ravenelle et al. ..... 336/200
2011/0012741 A1 * 1/2011 Garcia ..... 340/666
2013/0222145 A1 * 8/2013 Garcia ..... 340/644

* cited by examiner

*Primary Examiner* — Ronald W Leja

(57) ABSTRACT

An anti-intrusion mat preferably includes a floor mat; a power source, a high current generator and a plurality of electrodes. Such an arrangement may enable the device to be infused with an electrically charged current. In this manner, users may be able to effectively disarm and disable a would-be intruder before they gain entry into a home. The floor mat may be fabricated of a durable, rubberized material and include an attractive border fashioned from functional yet aesthetically pleasing Berber carpeting. The plurality of electrodes may be interwoven into the rubberized center portion of the floor mat where the perpetrator may likely be standing, to release electroshock currents when activated. Such an electroshock current may result in neuromuscular incapacitation to the perpetrator. The device may further be equipped with a handy remote control device to discreetly activate the electrodes.

9 Claims, 2 Drawing Sheets

ANTI-INTRUSION MAT AND ASSOCIATED USE THEREOF

CROSS REFERENCE TO RELATED APPLICATIONS

This application claims the benefit of U.S. Provisional Application No. 61/560,344 filed Nov. 16, 2012, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

This non-limiting exemplary embodiment(s) relates to security devices and, more particularly, to an anti-intrusion mat for providing users with an easy and convenient means of deterring a home intrusion by subduing a would-be criminal.

2. Prior Art

According to reports by the Federal Bureau of Investigation, overall crime rates have fallen by about a third in the United States since the early 1990s, one of the sharpest reductions since organized record keeping began early in the 20th century. In fact, 47 out of 50 states and 190 out of the biggest 220 U.S. cities cited a gradual yet steady drop in crime during the last decade. Although these reports are positive and foster a greater sense of security in this country, it is always wise to continue practicing sensible personal safety. Whether it is staying alert to surroundings while walking alone, keeping car and home doors locked at all times, or carrying little or no cash while out, these common sense security measures can considerably reduce one's chances of becoming a crime victim.

Perhaps one of the most feared crimes is the home invasion. The frightening thing about home invasion is that it is often motivated by a variety of criminal intentions, but most usually the intention is robbery. It is common for invaders to suddenly pull a weapon and burglarize a victim on the spot after impersonating a repairman, a delivery boy, salesman, policeman, or an individual in the need of a Good Samaritan. In a worst case scenario the intention is rape, kidnapping, torture, or terrorism. In these situations, an armed invader takes the victim by surprise simply by kicking in the door. Sometimes the invasion is motivated by the desire to procure normally private information such as a credit card or bank account number that can later be sold or used for fraudulent purposes.

In addition, a person may invade one's home for the purposes of preparing for a future robbery by assessing belongings and the vulnerability of entry points. Although exact statistics about the number of home invasions that take place every year are not available, it is estimated that each year this variant of robbery accounts for 11% of incidents of theft that take place in the United States. As such, concerned citizens are eager to implement extra security measures to prevent becoming a victim of such an invasive, frightening crime.

Accordingly, a need remains for a device in order to overcome the above-noted shortcomings. The present invention satisfies such a need by providing an anti-intrusion mat that is convenient and easy to use, lightweight yet durable in design, versatile in its applications, and designed for deterring a home intrusion by subduing a would-be criminal.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an anti-intrusion mat for deterring a home intrusion by subduing a would-be criminal. These and other objects, features, and advantages of the non-limiting exemplary embodiment(s) are provided by an anti-intrusion mat for deterring a home intrusion by subduing a would-be criminal. Such an anti-intrusion mat including a floor mat including a receiver, a sensor-activated switch communicatively coupled to the receiver, a power source communicatively coupled to the sensor-activated switch, a high-current generator communicatively coupled to the power source and the sensor-activated switch, and a plurality of electrodes communicatively coupled to the high-current generator.

A portable hand-held remote control device is spaced from the floor mat. Such a remote control device generates and transmits instructions signals to the high-current generator for activating and deactivating the electrodes. Notably, the sensor-activated switch is automatically toggled between open and closed modes when a triggering event is detected at the floor mat. In this manner, the floor mat is infused with an electrically charged current upon receipt of a selected one of the instruction signals and while the sensor-activated switch is at the closed position.

In a non-limiting exemplary embodiment, the sensor-activated switch is directly coupled to the receiver, the power source, and the high-current generator.

In a non-limiting exemplary embodiment, the triggering event comprises: a minimal weight detected on the floor mat.

In a non-limiting exemplary embodiment, the electrodes are configured in a plurality of contiguously aligned rows spanning across a major surface area of the floor mat.

The present disclosure further includes a method of utilizing an anti-intrusion mat for deterring a home intrusion by subduing a would-be criminal. Such a method includes the chronological steps of: providing a floor mat including a receiver, a sensor-activated switch communicatively coupled to the receiver, a power source communicatively coupled to the sensor-activated switch, a high-current generator communicatively coupled to the power source and the sensor-activated switch, and a plurality of electrodes communicatively coupled to the high-current generator; and providing and spacing a portable hand-held remote control device from the floor mat.

The method further includes the chronological steps of: the sensor-activated switch automatically toggling between open and closed modes when a triggering event is detected at the floor mat; the remote control device generating and transmitting instructions signals to the high-current generator for activating and deactivating the electrodes; and infusing the floor mat with an electrically charged current by receiving a selected one of the instruction signals and by toggling the sensor-activated switch to the closed position.

There has thus been outlined, rather broadly, the more important features of non-limiting exemplary embodiment(s) of the present disclosure so that the following detailed description may be better understood, and that the present contribution to the relevant art(s) may be better appreciated.

There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
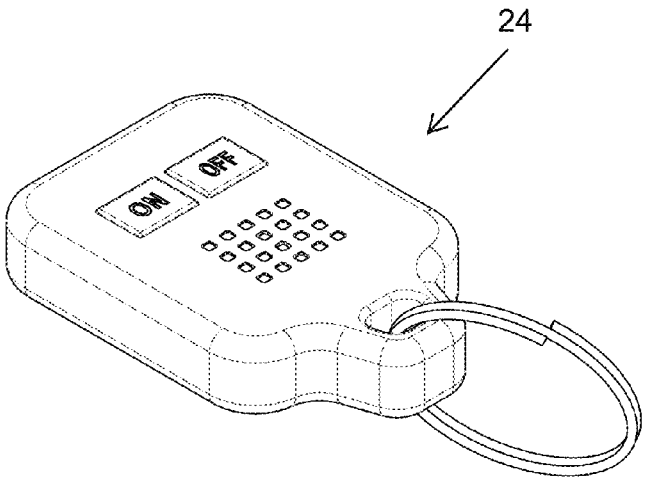
FIG. 1 is a perspective view showing a remote control device employed by an anti-intrusion mat, in accordance with the non-limiting exemplary embodiment(s)

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary emboidment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figure 2:
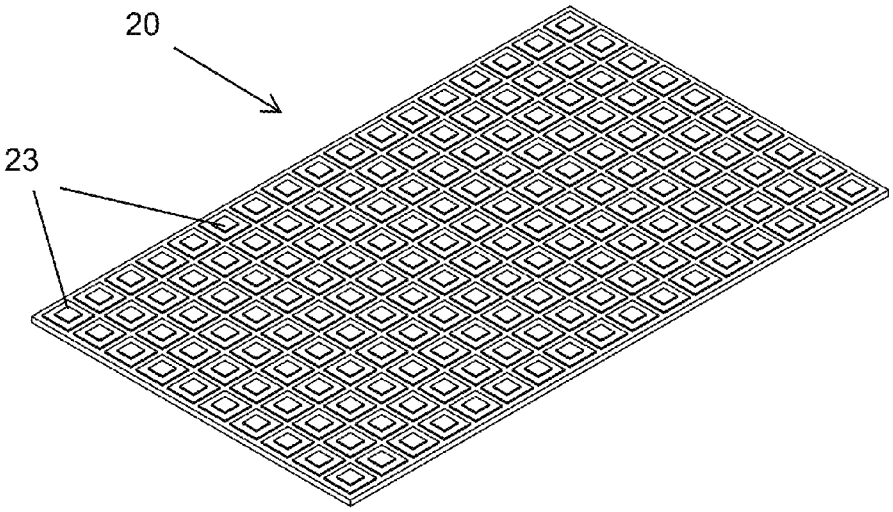
FIG. 2 is a perspective view showing a mat capable of being infused with an electrically charged current in response to an instruction signal from the remote control device shown in FIG. 1.
Figure 3:
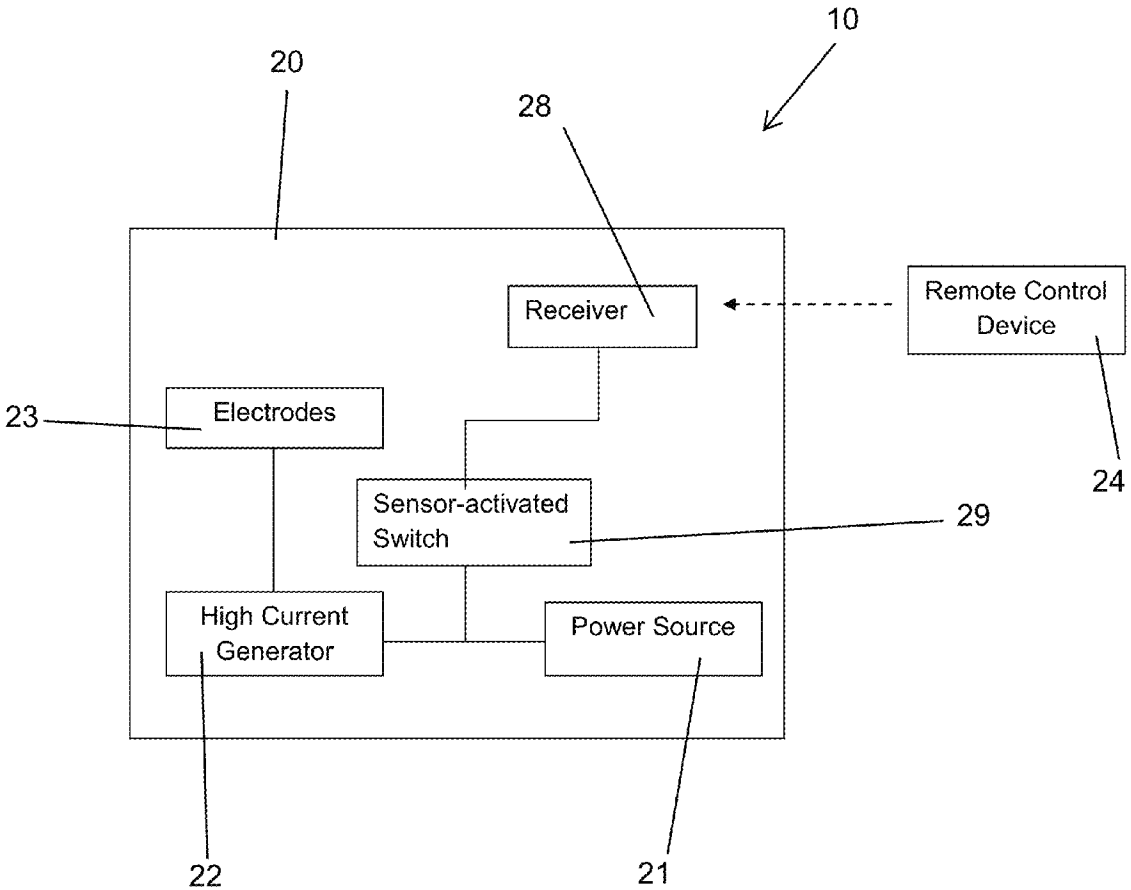
FIG. 3 is a schematic block diagram illustrating the interrelationship between major electronic components of an exemplary embodiment of the present disclosure.

The non-limiting exemplary embodiment(s) is/are referred to generally in FIGS. 1-3 and is/are intended to provide an anti-intrusion mat for deterring a home intrusion by subduing a would-be criminal. It should be understood that such non-limiting exemplary embodiment(s) may be used to deter many different types of criminals, and should not be limited to any particular criminal activity.

Referring to the FIGS. 1-3 in general, in a non-limiting exemplary embodiment, the anti-intrusion mat 10 includes a floor mat 20 including a receiver 28, a sensor-activated switch 29 communicatively coupled to the receiver 28, a power source 21 communicatively coupled to the sensor-activated switch 29, a high-current generator 22 communicatively coupled to the power source 21 and the sensor-activated switch 29, and a plurality of electrodes 23 communicatively coupled to the high-current generator 22. A portable hand-held remote control device 24 is spaced from the floor mat 20. Such a remote control device 24 generates and transmits instructions signals to the high-current generator 22 for activating and deactivating the electrodes 23. Notably, the sensor-activated switch 29 is automatically toggled between open and closed modes when a triggering event is detected at the floor mat 20. In this manner, the floor mat 20 is infused with an electrically charged current upon receipt of a selected one of the instruction signals and while the sensor-activated switch 29 is at the closed position.

In a non-limiting exemplary embodiment, the sensor-activated switch 29 is directly coupled to the receiver 28, the power source 21, and the high-current generator 22.

In a non-limiting exemplary embodiment, the triggering event comprises: a minimal weight detected on the floor mat. Thus, when a person is detected as standing on the floor mat 20, the sensor-activated switch 29 closes, thereby permitting the instruction signal to pass therethrough. When the person steps off the floor mat 20, the sensor-activated switch 29 opens, thereby prohibiting the instruction signal to pass therethrough.

In a non-limiting exemplary embodiment, the electrodes 23 are configured in a plurality of contiguously aligned rows spanning across a major surface area of the floor mat 20.

The present disclosure further includes a method of utilizing an anti-intrusion mat 10 for deterring a home intrusion by subduing a would-be criminal. Such a method includes the chronological steps of: providing a floor mat 20 including a receiver 28, a sensor-activated switch 29 communicatively coupled to the receiver 28, a power source 21 communicatively coupled to the sensor-activated switch 29, a high-current generator 22 communicatively coupled to the power source 21 and the sensor-activated switch 29, and a plurality of electrodes 23 communicatively coupled to the high-current generator 22; and providing and spacing a portable hand-held remote control device 24 from the floor mat 20.

The method further includes the chronological steps of: the sensor-activated switch 29 automatically toggling between open and closed modes when a triggering event is detected at the floor mat 20; the remote control device 24 generating and transmitting instructions signals to the high-current generator 22 for activating and deactivating the electrodes 23; and infusing the floor mat 20 with an electrically charged current by receiving a selected one of the instruction signals and by toggling the sensor-activated switch 29 to the closed position.

In a non-limiting exemplary embodiment, the anti-intrusion mat 10 may include a floor mat 20; a power source 21, a high current generator 22 and a plurality of electrodes 23. Such an arrangement may enable the device 10 to be infused with an electrically charged current. In this manner, users may be able to effectively disarm and disable a would-be intruder before they gain entry into a home.

In a non-limiting exemplary embodiment, the floor mat 20 may be rectangular in shape and measure approximately 4' in length and 5' in width. Largely fabricated of a durable, rubberized material, the floor mat 20 may feature an attractive border fashioned from aesthetically pleasing Berber carpeting. The plurality of electrodes 23 may be interwoven into the rubberized center portion of the floor mat 20 where the perpetrator may likely be standing, to release electroshock currents when activated. Such an electroshock current may result in neuromuscular incapacitation to the perpetrator. The device 10 may further be equipped with a handy remote control device 24 to discreetly activate the electrodes 23.

There are several significant benefits and advantages associated with the anti-intrusion mat 10. As a non-limiting example, the device 10 may provide homeowners with a simple and effective means of preventing a possible home invasion. Offering enhanced alarm reinforcement, the device 10 may sufficiently strengthen an entryway into the home. In this manner, even if a homeowner is fooled into cracking open a door for a visitor with nefarious intentions, the device 10 may be immediately activated, so that the criminal goes no further. As they are more susceptible to attack from a younger, stronger assailant, seniors may more effectively defend their homes with installation of the device 10. While the home invasion scenario has been the primary focus of this report, the device 10 may also benefit a vast array of businesses. Strategically placed at doorways or even in front of a checkout counter, such a device 10 may allow proprietors to completely disable a crook holding them up at gunpoint, or thwart the escape of a thief. In this manner, the device 10 may handily prevent loss of life as well as loss of property.

Use and application of the anti-intrusion mat 10 would be very simple and straightforward. First, the user may place the mat 20 directly in front of one's doorway, either inside or outside of the home. For added security, those who have more than one way into their house may wish to employ additional units. Should the user find himself/herself in a situation where an intruder attempts to push the door in on them, or should any unauthorized attempt be made, the device 10 may be activated via the user's remote control device 22. As a result, the intruder may be immediately stopped in his tracks, as the taser-like electrical currents completely incapacitate him. While halting a crime before it occurs, the device 10 may also buy the user time to notify police While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An anti-intrusion mat for deterring a home intrusion, said anti-intrusion mat comprising:

a floor mat including a receiver, a sensor-activated switch directly coupled to said receiver, a power source communicatively coupled to said sensor-activated switch, a high-current generator communicatively coupled to said power source and said sensor-activated switch, and a plurality of electrodes directly coupled to said high-current generator; and a remote control device generating and transmitting instructions signals to said high-current generator for activating and deactivating said electrodes;

wherein said sensor-activated switch is automatically toggled between open and closed modes when a triggering event is detected at said floor mat;

wherein said floor mat is infused with an electrically charged current upon receipt of a selected one of said instruction signals and while said sensor-activated switch is at the closed position.

2. The anti-intrusion mat of claim 1, wherein said sensor-activated switch is directly coupled to said receiver, said power source, and said high-current generator.

3. The anti-intrusion mat of claim 1, wherein said triggering event comprises: a minimal weight detected on said floor mat.

4. The anti-intrusion mat of claim 1, wherein said electrodes are configured in a plurality of contiguously aligned rows spanning across a major surface area of said floor mat.

5. An anti-intrusion mat for deterring a home intrusion, said anti-intrusion mat comprising:

a floor mat including a receiver, a sensor-activated switch directly coupled to said receiver, a power source communicatively coupled to said sensor-activated switch, a high-current generator communicatively coupled to said power source and said sensor-activated switch, and a plurality of electrodes directly coupled to said high-current generator; and a portable hand-held remote control device spaced from said floor mat, said remote control device generating and transmitting instructions signals to said high-current generator for activating and deactivating said electrodes;

wherein said sensor-activated switch is automatically toggled between open and closed modes when a triggering event is detected at said floor mat;

wherein said floor mat is infused with an electrically charged current upon receipt of a selected one of said instruction signals and while said sensor-activated switch is at the closed position.

6. The anti-intrusion mat of claim 5, wherein said sensor-activated switch is directly coupled to said receiver, said power source, and said high-current generator.

7. The anti-intrusion mat of claim 5, wherein said triggering event comprises: a minimal weight detected on said floor mat.

8. The anti-intrusion mat of claim 5, wherein said electrodes are configured in a plurality of contiguously aligned rows spanning across a major surface area of said floor mat.

9. A method of utilizing an anti-intrusion mat for deterring a home intrusion, said method comprising the chronological steps of:

providing a floor mat including a receiver, a sensor-activated switch directly coupled to said receiver, a power source communicatively coupled to said sensor-activated switch, a high-current generator communicatively coupled to said power source and said sensor-activated switch, and a plurality of electrodes directly coupled to said high-current generator;

providing and spacing a portable hand-held remote control device from said floor mat;

said sensor-activated switch automatically toggling between open and closed modes when a triggering event is detected at said floor mat;

said remote control device generating and transmitting instructions signals to said high-current generator for activating and deactivating said electrodes; and infusing said floor mat with an electrically charged current by receiving a selected one of said instruction signals and by toggling said sensor-activated switch to the closed position.

* * * * *